US006108623A

United States Patent [19]

Morel

[11] Patent Number: 6,108,623

[45] Date of Patent: Aug. 22, 2000

[54] COMFORT NOISE GENERATOR, USING SUMMED ADAPTIVE-GAIN PARALLEL CHANNELS WITH A GAUSSIAN INPUT, FOR LPC SPEECH DECODING

[75] Inventor: Cyrille Morel, Saint-Maurice, France

[73] Assignee: U.S. Philips Corporation, New York, N.Y.

[21] Appl. No.: 09/038,565

[22] Filed: Mar. 11, 1998

[30] Foreign Application Priority Data

Mar. 25, 1997 [FR] France ..... 97 03617

[51] Int. Cl.[7] ..... G10L 19/04

[52] U.S. Cl. ..... 704/219

[58] Field of Search ..... 704/219, 227, 704/228

[56] References Cited

U.S. PATENT DOCUMENTS

| | | | |
|---|---|---|---|
| 5,327,457 | 7/1994 | Leopold | 375/228 |
| 5,481,642 | 1/1996 | Shoham | 704/219 |
| 5,689,615 | 11/1997 | Benyassine | 704/219 |
| 5,719,992 | 2/1998 | Shoham | 704/219 |
| 5,828,997 | 10/1998 | Durlach et al. | 704/233 |
| 5,864,799 | 1/1999 | Corretjer et al. | 704/228 |

OTHER PUBLICATIONS

"Voice Control of the Pan–European Digital Mobile Radio System", C.B. Southcott et al., Communications Technology for the 1990's and Beyond, Dallas, Nov. 27–30, 1989, vol. 2 of 3, Nov. 27, 1989, Institute of Electrical and Electronics Engineers pp. 1070–1074.

Internationale Des Telecommunications (ITU), "Draft Recommendation G. 723– Dual Rate Speech Coder for Multimedia Telecommunication Transmitting at 5.3 and 6.3 KBITS/S", ITU, Study Group 15, 1995, 10th "LBC" Meeting, Newton, MA., USA.

*Primary Examiner*—David R. Hudspeth
*Assistant Examiner*—Tālivaldis Ivars Šmits
*Attorney, Agent, or Firm*—Edward W. Goodman

[57] ABSTRACT

A device for generating comfort noise for an LPC speech decoder which replaces silent periods with noise for a distant listener. The device includes and encoder for determining the energy characteristics of the frames of a signal to be transmitted, and a device for estimating LPC coefficients. The energy characteristics and the LPC coefficients are transmitted to a decoder which includes a comfort noise generator adding the outputs of parallel adaptive gain definition channels filtering a Gaussian noise. The received energy characteristics and LPC coefficients are used to fix the gain and weighting in these channels.

4 Claims, 1 Drawing Sheet

COMFORT NOISE GENERATOR, USING SUMMED ADAPTIVE-GAIN PARALLEL CHANNELS WITH A GAUSSIAN INPUT, FOR LPC SPEECH DECODING

BACKGROUND OF THE INVENTION

Field of the Invention

The invention relates to a device for generating comfort noise, and to a speech encoder and decoder including elements of such a device.

When speech signals are transmitted in network types transporting also data other than such signals, it is often useful to ensure that they do not occupy the whole pass-band and authorize the simultaneous passage of these other data, thus optimizing their bit-rates. Before transmission, a voice activity detector is provided with which the periods in which speech signals are present can be marked in input signals in which voice signals are mixed with noise and moments of silence.

If the presence of speech signals is detected, the subsequent speech encoder regularly transmits (in every frame) a stream of digital data which allows a distant receives to subsequently reconstitute these speech signals. If, in contrast, speech signals are no longer detected, encoded frames are no longer transmitted in the network so as to economize on their bit-rate. For the distant receiver, the signal samples are set at zero during these periods of speech absence. This solution is effective for bit-rate reduction, but may lead to erroneous unpleasant effects for the listener. Indeed, in the majority of cases, there is no total silence in the places where the conversation takes place, but rather, an ambient noise. If the input signal samples are set at zero at the moments of speech/silence transitions, the listener will have the impression of a discontinuity in the conversation, or even of a line cut-off.

SUMMARY OF THE INVENTION

It is a first object of the invention to provide a device for generating comfort noise, which remedies this drawback and, to this end, is characterized in that the device comprises, at the encoder end, a parallel arrangement of a circuit for determining the energy content of the current frame—the input signals being available in the form of successive frames of a predetermined length—and a circuit for determining the spectral envelope of this frame by way of a so-called LPC analysis, and, at the decoder end, a series arrangement of a circuit for generating Gaussian noise, a sub-assembly of two parallel gain-definition filtering channels, and an adder for the outputs of said channels, the frame of comfort noise reconstituted in the absence of speech signals in the current input frame being available at the output of said adder.

This device provides a better quality of the message to the distant listener. Indeed, when several frames containing the essential characteristics of ambient noise are transmitted during the periods of silence, this disagreeable impression of a line cut-off in the case of total silence is suppressed. Encoding of these several noise frames requires a much lower bit-rate because only the frequency and energy characteristics of the noise signal are transmitted, there characteristics being sufficient for restoring a substantially equivalent noise for the listener. Devices for generating comfort noise are already provided in speech encoders described, for example, in the recommendation recently issued by the Union Internationale des Télécommunications (ITU), "Draft Recommendation G.723—Dual rate speech coder for multimedia telecommunication transmitting at 5.3 and 6.3 kbits/s", ITU, Study Group 15, 1995, 10th "LBC Meeting", Newton, Mass., USA, in which a standard for a speech coder is defined. However, it should be noted that, in this case, the generation of comfort noise is rather inseparable from the speech encoder. In contrast, in the present case, the method performed does not depend on the encoder. Waveform codebooks are indeed no longer used, as it was usually the case in speech encoders. The addition of Gaussian noise to the filtered noise is particularly interesting when the ambient noise is very weak.

It is another object of the invention to provide speech encoder and decoder provided with a device for generating comfort noise as described hereinbefore.

These and other aspects of the invention are apparent from and will be elucidated with reference to the embodiments described hereinafter.

BRIEF DESCRIPTION OF THE DRAWING

The drawing shows an embodiment of a device for generating comfort noise according to the invention.

DESCRIPTION OF THE PREFERRED EMBODIMENT

Figure 1:
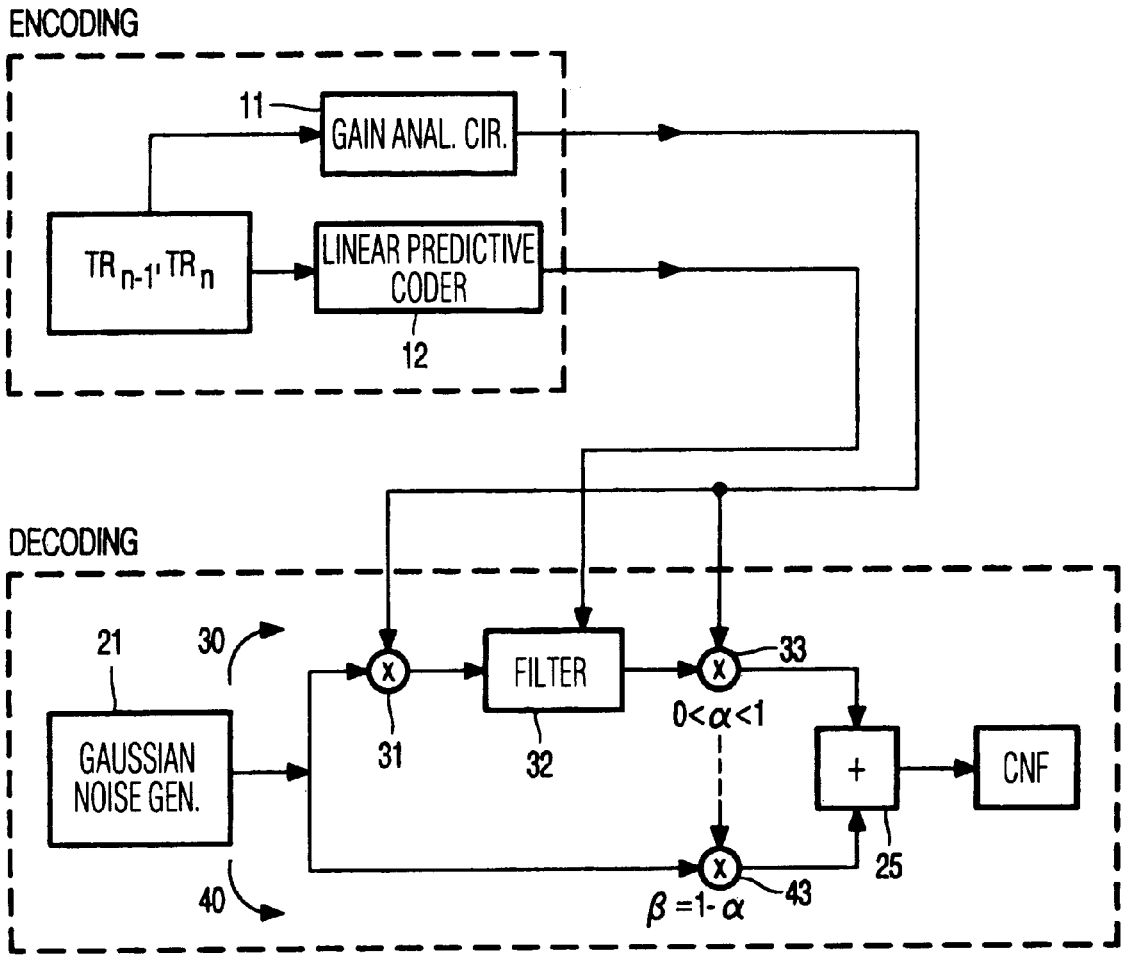

The input signals are available in the form of successive frames $TR_{1-1}$, $TR_n$, . . . etc. . . . of a predetermined length. As is shown in the FIGURE, the described device comprises a circuit 11 for determining the energy content of the current frame, also called gain analysis circuit, and a circuit 12 for determining the spectral envelope of this frame (from the frequency point of view) using Linear Predictive Coding (LPC) analysis, with which linear prediction coefficients are estimated. These characteristics of the input signals are quantized, encoded and transmitted.

At the decoder end, at which comfort noise for the distant listener is to be regenerated, the device comprises a circuit 21 for generating Gaussian noise (or, at least, noise being an approximation of Gaussian noise). This circuit is not a waveform codebook and needs, therefore, no memory. The computation that makes possible said generation is a real-time addition of pseudo-random numbers (the obtained signal is Gaussian if the number of iterations is high enough, about ten iterations being generally sufficient). This noise is transmitted in parallel through two gain definition channels 30 and 40, the first of which comprises a series arrangement of a gain circuit 31 (this gain is determined by the energy content—which has been transmitted—of the current field concerned), a filter 32 (having LPC coefficients derived from the spectral envelope—also transmitted), and a multiplier 33.

The output of this multiplier 33 and that of a similar multiplier 43 constituting the other channel 40 (these multipliers allow weightings by coefficients $\alpha$ and $1-\alpha$, respectively) constitute the inputs of an adder 25 whose output conveys the comfort noise frame CNF which is reconstituted in the absence of the speech signals.

For fixing the gain of one of the gain definition channels at the decoder end, the energy contact of the field concerned had been determined and quantized at the encoder end, and the filter coefficients of the same channel, in which it is intended to regenerate, from a Gaussian noise (on which the filtering operation is performed) a noise having substantially the same spectral characteristics as the original noise have also been estimated and quantized. At the listening end, this reconstituted noise is not exactly the same as the original noise, but the quality is clearly improved because the sudden transitions between speech and total silence are henceforth avoided.

It should be noted that the present invention is not limited to this embodiment from which variants can be conceived. For example, for decoding, the fact can be taken into account that the bit-rate has been reduced by not transmitting an encoded frame each time: to reduce the abrupt transitions, it is possible to perform an interpolation with the preceding frames as far as the energy content and the spectral envelope are concerned. The quality may also be improved by performing an interpolation of the energy content of the past frames at the encoder end.

What is claimed is:

1. A device for generating comfort noise for a speech encoding/decoding system, characterized in that said device comprises:

an encoder having a parallel arrangement of:

circuit means for determining an energy content of a current frame in an input signal to be transmitted by said speech encoding/decoding system, said input signal having successive frames of a predetermined length;

a circuit for determining a spectral envelope of said current frame using linear predictive coding (LPC) analysis; and means for quantizing, encoding and transmitting said determined energy content and said spectral envelope, and a decoder having a series arrangement of:

a circuit for generating Gaussian noise, a sub-assembly of two parallel-arranged gain definition channels coupled to an output of said circuit for generating Gaussian noise, a first channel of said two parallel-arranged gain definition channels receiving said determined energy content and said spectral envelope for processing said Gaussian noise, and an adder for adding output signals of the two parallel-arranged gain definition channels, an output of said adder providing the comfort noise frame which is reproduced by said speech encoding/decoding system in the absence of speech signals in each frame of a decoded signal.

2. The device as claimed in claim 1, in which the first channel includes:

gain circuit means having an input coupled to receive said Gaussian noise, the gain of said gain circuit means being controlled by said determined energy content;

a filter coupled to an output of said gain circuit means, said filter receiving said spectral envelope as filter coefficients; and a multiplier for multiplying an output of said filter by a first weighting coefficient $\alpha$, and in which a second channel of said two parallel-arranged gain definition channels includes a multiplier for multiplying by a second weighting coefficient $(1-\alpha)$ complementary to said first weighting coefficient $(\alpha)$.

3. A speech decoder for decoding an LPC encoded input signal containing a speech signal, characterized in that for generating comfort noise in the absence of a speech signal in said encoded input signal, said speech decoder further comprises:

circuit means for generating Gaussian noise;

a sub-assembly of two parallel-arranged gain definition channels coupled to an output of said circuit for generating Gaussian noise, a first channel of said two parallel-arranged gain definition channels receiving decoded energy content and spectral envelope for processing said Gaussian noise; and an adder for adding output signals of said two parallel-arranged gain definition channels, an output of said adder providing the comfort noise frame which is reproduced by said speech encoding/decoding system in the absence of speech signals in each frame of a decoded signal.

4. The speech decoder as claimed in claim 3, in which the first channel includes:

gain circuit means having an input coupled to receive said Gaussian noise, the gain of said gain circuit means being controlled by said determined energy content;

a filter coupled to an output of said gain circuit means, said filter receiving said spectral envelope as filter coefficients; and a multiplier for multiplying an output of said filter by a first weighting coefficient $\alpha$, and in which a second channel of said two parallel-arranged gain definition channels includes a multiplier for multiplying by a second weighting coefficient $(1-\alpha)$ complementary to said first weighting coefficient $(\alpha)$.

* * * * *